US007828420B2

(12) United States Patent
Fagerquist et al.

(10) Patent No.: US 7,828,420 B2
(45) Date of Patent: Nov. 9, 2010

(54) CONTINUOUS INK JET PRINTER WITH MODIFIED ACTUATOR ACTIVATION WAVEFORM

(75) Inventors: Randy L. Fagerquist, Beavercreek, OH (US); Ornit Hadar, Vancouver (CA); Julia A. Gayhart, Tipp City, OH (US); Robert J. Simon, Bellbrook, OH (US)

(73) Assignee: Eastman Kodak Company, Rochester, NY (US)

( * ) Notice: Subject to any disclaimer, the term of this patent is extended or adjusted under 35 U.S.C. 154(b) by 799 days.

(21) Appl. No.: 11/749,187

(22) Filed: May 16, 2007

(65) Prior Publication Data

US 2008/0284827 A1 Nov. 20, 2008

(51) Int. Cl.
*B41J 2/09* (2006.01)

(52) U.S. Cl. ..... 347/77

(58) Field of Classification Search ..... 347/73, 347/74, 77

See application file for complete search history.

(56) References Cited

U.S. PATENT DOCUMENTS

| | | | | |
|---|---|---|---|---|
| 1,941,001 | A | 12/1933 | Hansell | |
| 3,373,437 | A | 3/1968 | Sweet et al. | |
| 3,709,432 | A | 1/1973 | Robertson | |
| 6,079,821 | A | 6/2000 | Chwalek et al. | |
| 6,505,921 | B2 * | 1/2003 | Chwalek et al. | 347/77 |
| 6,851,796 | B2 | 2/2005 | Jeanmaire et al. | |
| 2007/0064066 | A1 | 3/2007 | Piatt et al. | |

FOREIGN PATENT DOCUMENTS

| | | |
|---|---|---|
| WO | WO 2007/031500 | 3/2007 |

OTHER PUBLICATIONS

Lord Rayleigh, "On the Instability of Jets," *Proc. London Math.* Soc. X (1878).

* cited by examiner

*Primary Examiner*—An H Do
(74) *Attorney, Agent, or Firm*—William R. Zimmerli

(57) ABSTRACT

A drop generator is operated to form large-volume and small-volume droplets by providing a droplet generator having a nozzle and an adjustable stimulation device; supplying liquid to the droplet generator such that a stream of diameter D emanates from the nozzle; activating the stimulation device to produce a first set of perturbations on the liquid stream, the perturbations having a period x such as to cause the liquid stream to form into small-volume droplets; selectively adjusting the stimulation device to produce a second set of perturbations on the liquid stream, the second set of perturbations having a period Nx such as to cause a segment of the liquid stream to form into a large-volume droplet, whereby the large-volume droplet is N times the volume of the small-volume droplets; and further adjusting the stimulation device to produce a third set of perturbations on the liquid stream during the period Nx.

11 Claims, 10 Drawing Sheets

| RELATIVE AMPLITUDE | DUTY CYCLE (%) | RELATIVE PERIOD | RELATIVE DROPLET SIZE |
|---|---|---|---|
| 1 | 8.75 | 4000 | 4X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |

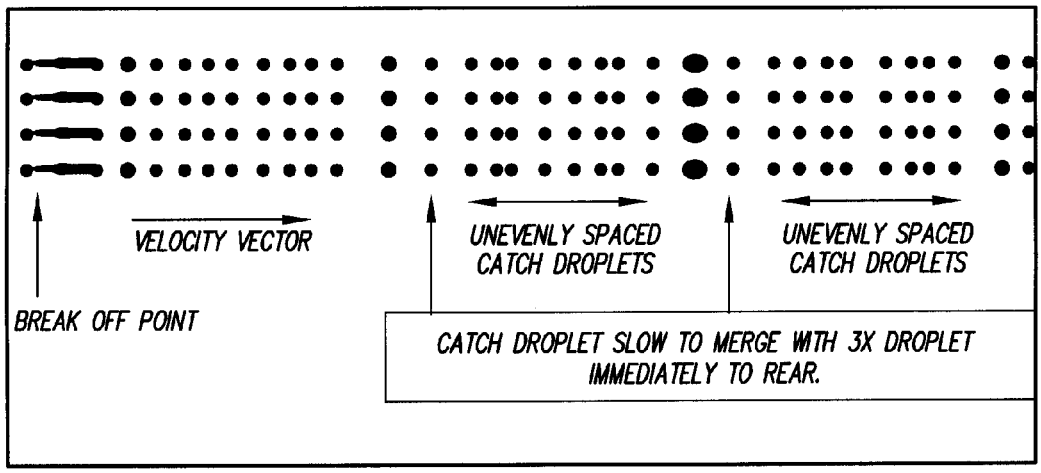
FIG. 7
| BOL (mm) | LDFL (mm) | SD-SD (mm) |
|---|---|---|
| 1.11 | 4.66 | 3.71 |
FIG. 8
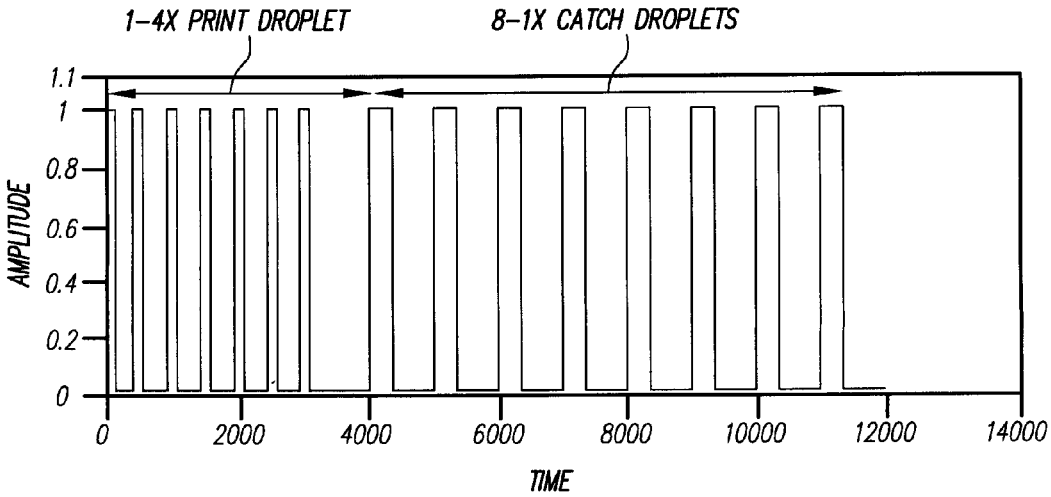
FIG. 9

| RELATIVE AMPLITUDE | DUTY CYCLE (%) | RELATIVE LENGTH | RELATIVE DROP SIZE |
|---|---|---|---|
| 1 | 35 | 500 | 4X |
| 1 | 35 | 500 | 4X |
| 1 | 35 | 500 | 4X |
| 1 | 35 | 500 | 4X |
| 1 | 35 | 500 | 4X |
| 1 | 35 | 500 | 4X |
| 1 | 35 | 500 | 4X |
| 1 | 0 | 500 | 4X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |

| BOL (mm) | LDFL (mm) | LD-SD (mm) |
|---|---|---|
| 1.09 | 2.10 | 5.79 |

| RELATIVE AMPLITUDE | DUTY CYCLE (%) | RELATIVE LENGTH | RELATIVE DROP SIZE |
|---|---|---|---|
| 1 | 35 | 500 | 4X |
| 1 | 35 | 500 | 4X |
| 1 | 35 | 500 | 4X |
| 1 | 35 | 500 | 4X |
| 1 | 35 | 500 | 4X |
| 1 | 35 | 500 | 4X |
| 1 | 80 | 500 | 4X |
| 1 | 0 | 500 | 4X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |
| 1 | 35 | 1000 | 1X |

| BOL (mm) | LDFL (mm) | LD-SD (mm) |
|---|---|---|
| 0.98 | 1.83 | 6.38 |

CONTINUOUS INK JET PRINTER WITH MODIFIED ACTUATOR ACTIVATION WAVEFORM

FIELD OF THE INVENTION

This invention relates generally to the field of digitally controlled printing devices, and in particular to continuous ink jet printers in which a liquid ink stream breaks into droplets, some of which are selectively deflected.

BACKGROUND OF THE INVENTION

Traditionally, digitally controlled color printing capability is accomplished by one of two technologies. Both require independent ink supplies for each of the colors of ink provided. Ink is fed through channels formed in the printhead. Each channel includes a nozzle from which droplets of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce, in general, up to several million shades or color combinations.

The first technology, commonly referred to as "droplet on demand" ink jet printing, selectively provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle helping to keep the nozzle clean.

Conventional droplet on demand ink jet printers utilize a heat actuator or a piezoelectric actuator to produce the ink jet droplet at orifices of a print head. With heat actuators, a heater, placed at a convenient location, heats the ink to cause a localized quantity of ink to phase change into a gaseous steam bubble that raises the internal ink pressure sufficiently for an ink droplet to be expelled. With piezoelectric actuators, a mechanical force causes an ink droplet to be expelled.

The second technology, commonly referred to as "continuous stream" or simply "continuous" ink jet printing, uses a pressurized ink source that produces a continuous stream of ink droplets. Traditionally, the ink droplets are selectively electrically charged. Deflection electrodes direct those droplets that have been charged along a flight path different from the flight path of the droplets that have not been charged. Either the deflected or the non-deflected droplets can be used to print on receiver media while the other droplets go to an ink capturing mechanism (catcher, interceptor, gutter, etc.) to be recycled or disposed. U.S. Pat. No. 1,941,001, issued to Hansell, on Dec. 26, 1933, and U.S. Pat. No. 3,373,437 issued to Sweet et al., on Mar. 12, 1968, each disclose an array of continuous ink jet nozzles wherein ink droplets to be printed are selectively charged and deflected towards the recording medium.

U.S. Pat. No. 3,709,432, issued to Robertson, on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers with high amplitude stimulation resulting in short filaments and low amplitudes resulting in long filaments. A flow of air across the paths of the fluid at a point intermediate to the ends of the long and short filaments affects the trajectories of the filaments before they break up into droplets more than it affects the trajectories of the ink droplets themselves. Thus, by controlling the lengths of the filaments, the trajectories of the ink droplets can be controlled, or switched from one path to another. As such, some ink droplets may be directed into a catcher while allowing other, selected ink droplets to be applied to a receiving member.

U.S. Pat. No. 6,079,821, issued to Chwalek et al., on Jun. 27, 2000, discloses a continuous ink jet printer that uses actuation of asymmetric heaters to create individual ink droplets from a filament of working fluid and to deflect those ink droplets. A printhead includes a pressurized ink source and asymmetric heaters, operable to form printed ink droplets and non-printed ink droplets. Printed ink droplets flow along a printed ink droplet path ultimately striking a print media, while non-printed ink droplets flow along a non-printed ink droplet path ultimately striking a catcher surface. These non-printed ink droplets are then recycled or disposed of through an ink removal channel formed in the catcher. While the ink jet printer disclosed in Chwalek et al. works extremely well for its intended purpose, using the asymmetric heater to create and deflect ink droplets increases the energy and power requirements of this device.

In U.S. Pat. No. 6,851,796, which issued on Feb. 8, 2005, an ink droplet forming mechanism selectively creates a stream of ink droplets having a plurality of different volumes traveling along a first path. An air flow directed across the stream of ink droplets interacts with the stream of ink droplets. This interaction deflects smaller droplets more than larger droplets and thereby separates ink droplets having one volume from ink droplets having other volumes.

As the drop selection mechanism described above depends on drop size, it is necessary for large-volume droplets to be fully formed before being exposed to the deflection air flow. Consider, for example, a case where the large-volume droplet is to have a volume equal to four small-volume droplets. It is often seen during droplet formation that the portion of the ink stream that is to form the large-volume droplet will separate from the main stream as desired, but will then break apart before coalescing to form the large-volume droplet. It is necessary for this coalescence to be complete prior to passing through the droplet deflecting air flow. Otherwise the separate fragments that are to form the large-volume droplet will be deflected by an amount greater than that of a single large-volume droplet. Similarly, the small-volume droplets must not merge in air before having past the deflection air flow. If separate small-volume droplets merge, they will be deflected less than desired.

It has been found that the small-volume droplets between coalesced large-volume droplets can be very unevenly spaced. In extreme circumstances, the large-volume droplet often remains only partially formed until the large-volume droplet is well beyond the deflection air flow. The partially formed large-volume droplet and the small-volume droplet immediately in front of it must merge to produce the completed large-volume droplet. Occasionally, an undesirable merging of a small-volume droplet and a large-volume droplet will occur at some distance from the orifices. It is desirable to have the merging droplets coalesce as quickly as possible after break off without additional merging of the small-volume droplets with large-volume droplets or with adjacent small-volume droplets.

SUMMARY OF THE INVENTION

Accordingly, it is an object of the present invention to have large droplet fragments coalesce as quickly as possible after break off and without the merging of the small-volume droplets with large-volume droplets or with adjacent small-volume droplets.

It is another object of the present invention to improve the uniformity of drop velocity of the small-volume droplets so that undesirable merging of small-volume droplets is delayed.

These and other objects of the present invention are accomplished, in part, by manipulating droplet velocity and break off time using specialized voltage/current pulse waveforms delivered to the heater resistors of the device.

Accordingly, it is a feature of the present invention to operate a liquid drop generator for selective formation of large-volume droplets and small-volume droplets by providing a droplet generator having a nozzle opening and an associated and adjustable stimulation device; supplying a liquid under pressure to the droplet generator such that a liquid stream of a predetermined diameter, D, emanates from the nozzle opening; activating the associated stimulation device to produce a first set of perturbations on the diameter of the liquid stream, the perturbations having a period, x, such as to cause the liquid stream to form into small-volume droplets; selectively adjusting the stimulation device to produce a second set of perturbations on the diameter of the liquid stream, the second set of perturbations having a period, Nx, such as to cause a segment of the liquid stream to form into a large-volume droplet, whereby the large-volume droplet is N times the volume of the small-volume droplets; and further adjusting the stimulation device to produce a third set of perturbations on the diameter of the liquid stream during the period Nx, the time period, $\tau$, between the perturbations of the third set of perturbations being sufficiently short that the segment of the liquid stream that forms the large-volume droplet is not broken up thereby.

BRIEF DESCRIPTION OF THE DRAWINGS

Other features and advantages of the present invention will become apparent from the following description of the preferred embodiments of the invention and the accompanying drawings, wherein:

FIG. 7 is an image of droplets produced by the waveform of FIG. 5;

FIG. 8 is a table of the droplet generation results the waveform of FIG. 5;

FIG. 9 is a graph of a waveform for producing a single large-volume droplet followed by eight small-volume droplets according to a feature of the present invention;

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
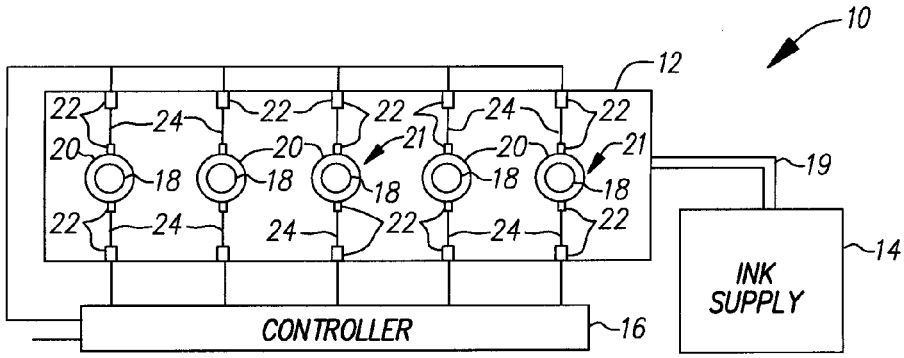
FIG. 1 is a schematic view of a printhead made in accordance with a preferred embodiment of the present invention.

Referring to FIG. 1, a printing apparatus 10 includes a printhead 12, at least one ink supply 14, and a controller 16. In a preferred embodiment of the present invention, printhead 12 is formed from a semiconductor material (silicon, etc.) using known semiconductor fabrication techniques (CMOS circuit fabrication techniques, micro electro mechanical structure (MEMS) fabrication techniques, etc.). However, printhead 12 may be formed from any materials using any fabrication techniques conventionally known in the art.

At least one nozzle 18 is formed on printhead 12. Nozzle 18 is in fluid communication with ink supply 14 through an ink passage 19 also formed in printhead 12. Printhead 12 can incorporate additional ink supplies with corresponding nozzles in order to provide multi-drop gray scale printing and/or color printing using multiple ink colors.

An ink droplet forming stimulation device 21 is positioned proximate to nozzle 18. In this embodiment, stimulation device 21 is a heater 20. However, ink droplet forming stimulation device 21 can also be a piezoelectric actuator, a thermal actuator, etc. Heater 20 is at least partially formed or positioned on printhead 12 around a corresponding nozzle 18. Although heater 20 may be disposed radially away from an edge of corresponding nozzle 18, heater 20 is preferably disposed close to corresponding nozzle 18 in a concentric manner. In a preferred embodiment, heater 20 is formed in a substantially circular or ring shape. However, heater 20 can be formed in a partial ring, square, etc. Heater 20, in a preferred embodiment, includes an electric resistive heating element electrically connected to electrical contact pads 22 via conductors 24.

Conductors 24 and electrical contact pads 22 may be at least partially formed or positioned on printhead 12 and provide an electrical connection between controller 16 and heater 20. Alternatively, the electrical connection between controller 16 and heater 20 may be accomplished in any well-known manner. Additionally, controller 16 may be a relatively simple device (a power supply for heater 20, etc.) or a relatively complex device (logic controller, programmable microprocessor, etc.) operable to control many components (heater 20, ink droplet forming mechanism 10, etc.) in a desired manner.

Figure 2A:
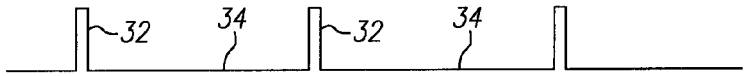
FIGS. 2(*a*)-2(*f*) illustrates a frequency control of a heater according to the prior art.
Figure 2B:
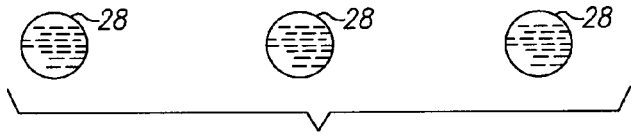
Figure 2C:
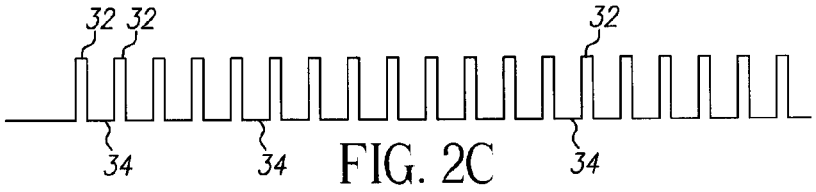
Figure 2D:
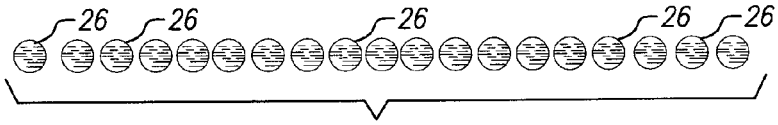
Figure 2E:
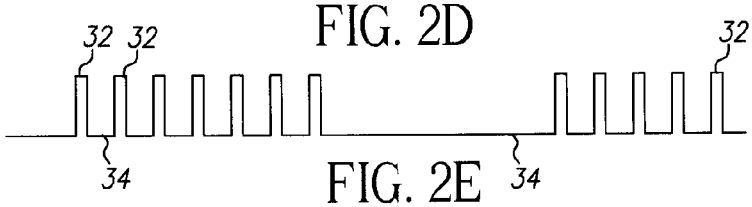
Figure 2F:
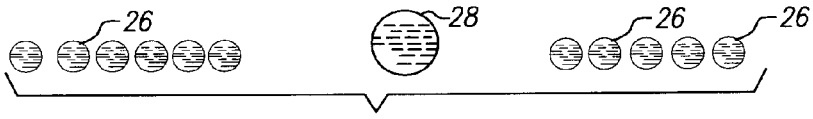

FIGS. 2*a*-2*b* illustrate an example of electrical activation waveforms provided by controller 16 to heater 20 according to the prior art. Generally, a high frequency of activation of heater 20 results in small-volume droplets 26, while a low frequency of activation of heater 20 results in large-volume droplets 28. Depending on the application, either large-volume droplets 28 or small-volume droplets 26 can be used for printing while small-volume droplets 26 or large-volume droplets 28 are captured for ink recycling or disposal.

The electrical waveform of heater 20 actuation for one printing case is presented schematically in FIG. 2(*a*). The individual large-volume droplets 28 resulting from the jetting of ink from nozzle 18, in combination with this heater actuation, are shown schematically in FIG. 2(*b*). Heater 20 activation pulse 32 is typically 0.1 to 5 microseconds in duration, and in this example is 1.0 microsecond. The delay time 34 between heater 20 actuations is 42 microseconds. The electrical waveform of heater 20 activation for one non-printing case is given schematically as FIG. 2(*c*). Activation pulse 32 is 1.0 microsecond in duration, and the delay time 36 between activation pulses is 6.0 microseconds. The small-volume droplets 26, as diagrammed in FIG. 2(*d*), are the result of the activation of heater 20 with this non-printing waveform. This ratio of actuation pulse time to the total period (actuation pulse time plus delay time) is known within the art as duty cycle.

FIG. 2(*e*) is a schematic representation of the electrical waveform of heater 20 activation for mixed image data wherein a transition is shown from a non-printing state, to a printing state, and back to a non-printing state. FIG. 2(*f*) is the resultant droplet stream formed. It is apparent that heater 20 activation may be controlled independently based on the ink color required and ejected through corresponding nozzle 18, movement of printhead 12 relative to a print media W, and an image to be printed. Additionally, the volume of the small-volume droplets 26 and the large-volume droplets 28 can be adjusted based upon specific printing requirements such as ink and media type or image format and size.

Figure 3:
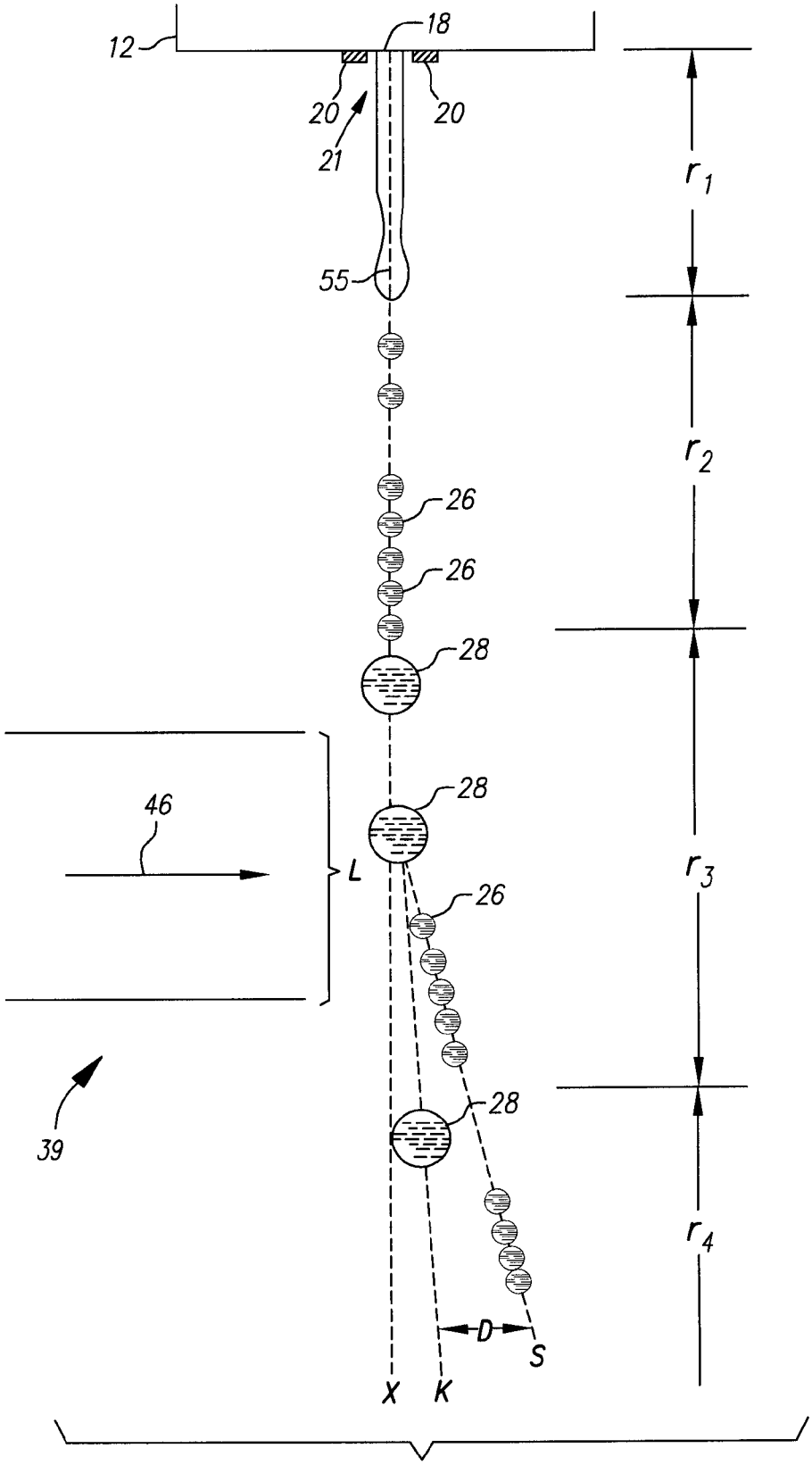
FIG. 3 is a cross-sectional view of an inkjet printhead showing how ink droplets of different volumes are separated when air flow that is directed across the stream of ink droplets interacts with the stream of ink droplets.

Referring to FIG. 3, the operation of printhead 12 in a manner such as to provide an image-wise modulation of drop volumes, as described above, is coupled with a system 39 which separates droplets into printing or non-printing paths according to drop volume. Ink is ejected through nozzle 18 in printhead 12, creating a filament of working fluid 55 moving substantially perpendicular to printhead 12 along axis X. The physical region over which the filament of working fluid 55 is intact is designated as $r_1$. Heater 20 (ink droplet forming mechanism 21) is selectively activated at various frequencies according to image data, causing filament of working fluid 55 to break up into a stream of individual ink droplets 26, 28. Some coalescence of drops often occurs in forming large-volume droplets 28. This region of jet break-up and drop coalescence is designated as $r_2$ Following region $r_2$, drop formation is complete in region $r_3$, such that at the $r_3$ distance from the printhead 12 that the system 39 is applied, droplets 26, 28 are substantially in two size classes: small-volume droplets 26 and large-volume drops 28. In the preferred implementation, the system includes a force 46 provided by a gas flow substantially perpendicular to axis X. The force 46 acts over distance, L, which is less than or equal to distance $r_3$. Large-volume droplets 28 have a greater mass and more momentum than small-volume droplets 26. As gas force 46 interacts with the stream of ink droplets, the individual ink droplets separate depending on each droplets volume and mass. Accordingly, the gas flow rate can be adjusted to sufficient differentiation D in the small-volume droplet path, S, from the large-volume droplet path, K, permitting large-volume droplets 28 to strike print media W while small-volume droplets 26 are captured by an ink catcher structure described below. Alternatively, small-volume droplets 26 can be permitted to strike print media W while large-volume droplets 28 are collected by slightly changing the position of the ink catcher.

Figure 4:
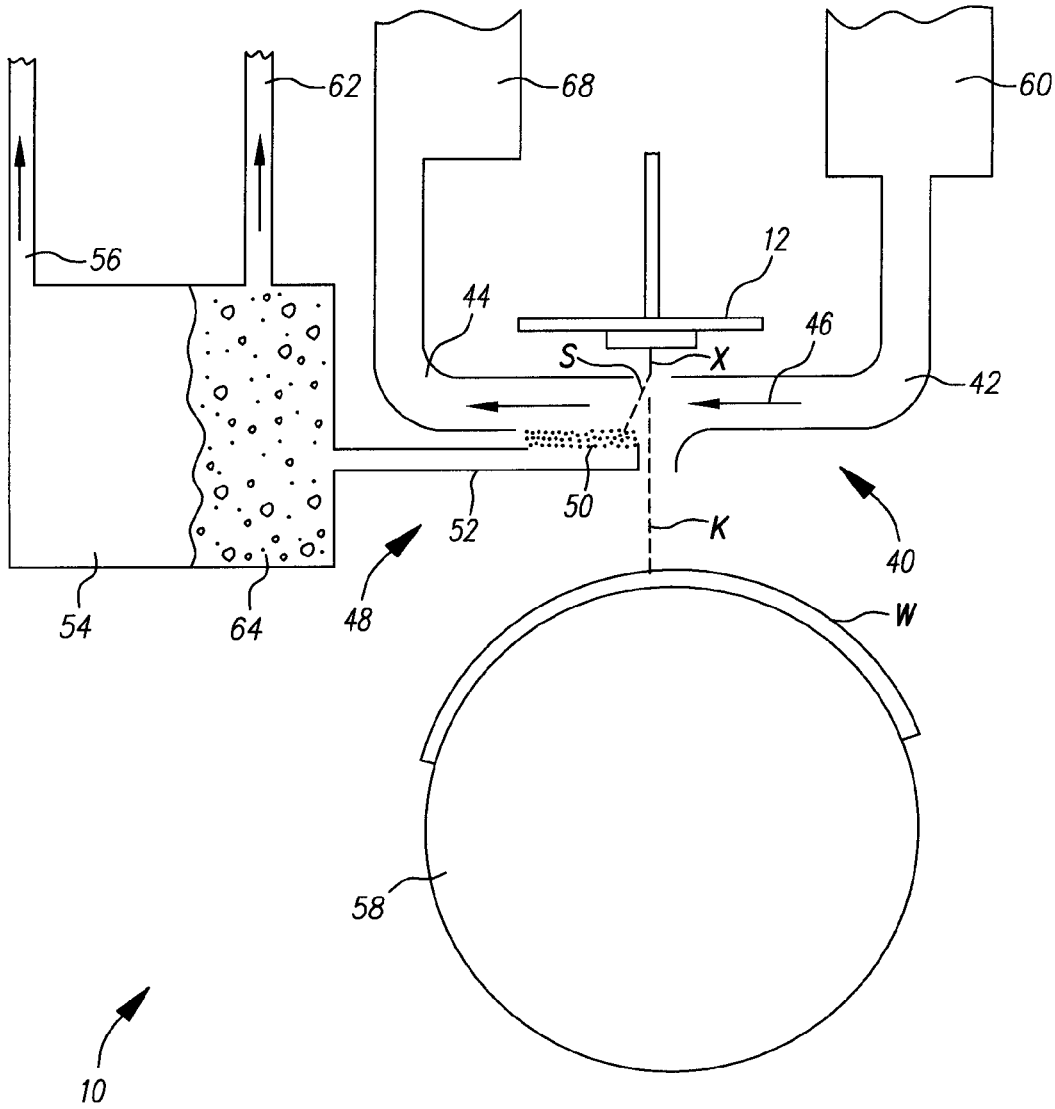
FIG. 4 is a schematic view of an ink jet printer showing the effect of droplet separation by volume.

Referring to FIG. 4, large-volume droplets 28 and small-volume droplets 26 are formed from ink ejected in a stream from printhead 12 substantially along ejection path X. A droplet deflector 40 contains an upper plenum 42 and a lower plenum 44, which facilitate a laminar flow of gas in droplet deflector 40. Pressurized air from pump 60 enters upper plenum 42 which is disposed opposite lower plenum 44 and promotes laminar gas flow while protecting the droplet stream moving along path X from external air disturbances. Vacuum pump 68 communicates with lower plenum 44 and provides a sink for gas flow. In the center of droplet deflector 40 is positioned proximate path X. The application of force 46 due to gas flow separates the ink droplets into small-drop path S and large-drop path K.

An ink collection structure 48, disposed on one wall of lower plenum 44 near path X, intercepts the path of small-volume droplets 26 moving along path S, while allowing large-volume droplets 28 traveling along large-volume droplet path K to continue on to the recording media W carried by print drum 58. Small-volume droplets 26 strike porous element 50 in ink collection structure 48. Porous element 50 can be a wire screen, mesh, sintered stainless steel, or ceramic-like material. Small-volume droplets 26 are drawn into the recesses in the porous material 50 by capillary forces and therefore do not form large-volume droplets on the surface of porous element 50. Ink recovery conduit 52 communicates with the back side of porous element 50 and operates at a reduced gas pressure relative to that in lower plenum 44. The pressure reduction in conduit 52 is sufficient to draw in recovered ink, however it is not large enough to cause significant air flow through porous element 50. In this manner of operation, foaming of the recovered ink is minimized. Ink recovery conduit 52 communicates also with recovery reservoir 54 to facilitate recovery of non-printed ink droplets by an ink return line 56 for subsequent reuse. Ink recovery reservoir 54 can contain an open-cell sponge or foam 64, which prevents ink sloshing in applications where the printhead 12 is rapidly scanned. A vacuum conduit 62, coupled to a negative pressure source can communicate with ink recovery reservoir 54 to create a negative pressure in ink recovery conduit 52 improving ink droplet separation and ink droplet removal as discussed above.

The gas pressure in droplet deflector 40 is adjusted in combination with the design of plenums 42, 44 so that the gas pressure in the print head assembly near ink guttering structure 48 is positive with respect to the ambient air pressure near print drum 58. Environmental dust and paper fibers are thusly discouraged from approaching and adhering to ink guttering structure 48 and are additionally excluded from entering lower plenum 44.

In operation, a recording media W is transported in a direction transverse to axis x by print drum 58 in a known manner. Transport of recording media W is coordinated with movement of printing apparatus 10 and/or movement of printhead 12. This can be accomplished using controller 16 in a known manner. Recording media W may be selected from a wide variety of materials including paper, vinyl, cloth, other fibrous materials, etc.

Droplet generation from continuous ink jet devices for use in air deflection print heads requires production of droplets in a predictable fashion having binary volumes. For example, small-volume droplets my have a fundamental volume of "x" and large-volume droplets, that are comprised of multiple "N" coalesced small-volume droplets, may have volumes Nx. That is, N of the 1x small-volume droplets merging in flight after break off creates one Nx large-volume droplet. For this description, it is assumed that N=4 and the large-volume droplet volume is 4x.

By way of background to the droplet formation process, ink supplied to the drop generator passes through the nozzles of the orifice plate, forming a cylinder of fluid having a diameter, D, which is also approximately the diameter of the nozzle. This cylinder, or jet of fluid, moves at a velocity $V_{jet}$. When an activation drive pulse is applied to the stimulation device (i.e., the heater 20 surrounding the nozzle), a perturbation is created in the diameter of the jet at the nozzle. This perturbation moves with the fluid at the velocity, $V_{jet}$. If another pulse is applied to the stimulation device, another perturbation is created in the diameter of the jet at the nozzle, which also moves with the jet at $V_{jet}$. It is well known that if the spacing of the perturbations on the jet is greater than Rayleigh limit, that is approximately $\pi$*D, then the amplitude of the perturbation can grow (see generally, Lord Rayleigh, "On the Instability of Jets," *Proc. London Math.* Soc. X (1878)). As the perturbation grows, eventually it will grow to the point that it will cause a drop to separate from the jet. On the other hand, if the spacing is less than the Rayleigh limit, the amplitude of the perturbation will shrink, and it will not cause a drop to break off from the jet.

Figures 5, 6:
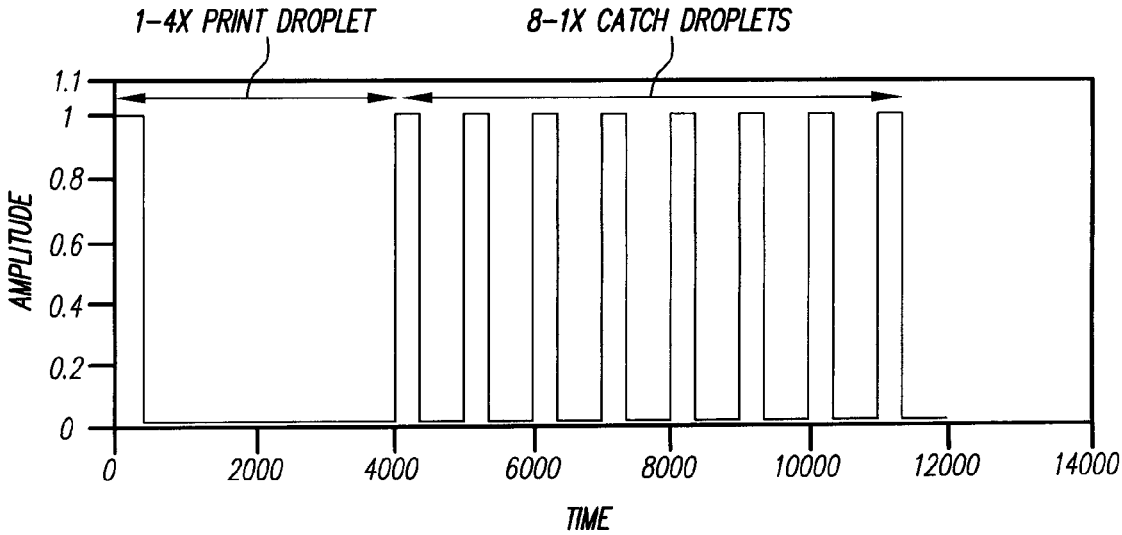
FIG. 5 is a graph of a standard waveform currently used for producing a single large-volume droplet followed by eight small-volume droplets.
FIG. 6 is a table of data for the waveform of FIG. 5.

An example of the traditional waveform of activation drive pulses used for producing a single 4x large-volume droplet followed by eight small-volume droplets is shown as FIG. 5, where "x" is the volume of a small-volume droplet. The individual pulse amplitudes, periods, and duty cycles are variables and depend upon the specific ink, ink pressure, nozzle size, and droplet generation rates required. In one example, ink at room temperature and a pressure of 52 psi-53 psi was used with a 3.2" array length 300 pi droplet generator having an orifice diameter of 15 microns and a substrate thickness of 4 microns. The small-volume droplet generation frequency was set to 360 kHz and the pulse amplitude was a constant 3 Vdc, unless otherwise noted. A complete description of the pulse waveform of FIG. 5 is given by the waveform data in the table of FIG. 6, along with the carrier, or repeat, frequency $F_c$ of 30 kHz.

As previously described, each activation drive pulse so the stimulation device produces a perturbation on the liquid stream. The time between adjacent activation drive pulses 2-8 in the FIG. 5 waveform produces perturbations on the liquid stream that are spaced apart by a period x. At the spacing or period of perturbations of x, the perturbations grow and cause the liquid stream to break up into small-volume droplets. The time between activation drive pulses 1 and 2 is N times the time between adjacent pulses 2-8; where as shown N equals 4. As a result, the stimulation device produces a second set of perturbations on the diameter of the liquid stream. These perturbations in the second set have a period on the liquid stream of Nx and cause a segment of the fluid jet to form into a large-volume droplet having a volume N times the volume of the small-volume droplets.

The relative amplitude of each pulse, shown in Column 1 of the waveform data FIG. 6, which for all the waveforms discussed in this report, is one. The second column lists the duty cycle for each pulse in percent. The third column lists the number of points used to describe each pulse electronically by a waveform generator and can be considered the relative period for each pulse (i.e., the first pulse listed has a period four times that of each of the next eight pulses). The actual period of each pulse is determined by the relative pulse period, the total waveform period, and the carrier frequency. For example, a 1x small-volume droplet with a relative period of 1000 has a period of 2.78 μsec, and the period of the 4x large-volume droplet is 11.11 μsec. Droplets produced by this waveform being applied to a droplet generator with the jetting parameters previously given are shown as FIG. 7.

As can be seen in FIG. 7, the small-volume droplets between the partially coalesced large-volume droplets are very unevenly spaced. Also, the large-volume droplet remains 3x until the droplet is far beyond the right hand side of the image. The 3x droplet and the small-volume 1x droplet immediately in front of it must merge to produce the 4x large-volume droplet. The droplet generation result, illustrated in the table of FIG. 8, shows the measured break off length (BOL), large-volume droplet formation length (LDFL), and the (undesirable) small-volume droplet-to-small-volume droplet merge length (SD-SD). Occasionally, an undesirable merging of a small-volume droplet and a 4x large-volume droplet will occur at some distance from the orifices—usually well beyond the PDFL—and is referred to as the LD-SD merge length.

It is desirable to have the merging droplets coalesce as quickly as possible after break off without the merging of the 1x small-volume droplets with Nx large-volume droplets or with adjacent small-volume droplets. According to the present invention, controlling small-volume and large-volume droplet production from a continuous ink jet device is accomplished by manipulating droplet velocity and break off time using specialized voltage/current pulse waveforms delivered to the heater resistors of the device.

By way of background, ink supplied to the drop generator passes through the nozzles of the orifice plate, forming a cylinder of fluid having a diameter, D, which is approximately the diameter of the nozzle. This cylinder or jet of fluid moves at a velocity $V_{jet}$. When the pulses are applied to the stimulation device (i.e., the heater surrounding the nozzle), a perturbation is created in the diameter of the jet at the nozzle. This perturbation moves with the fluid. The perturbation therefore moves at the velocity, $V_{jet}$. If another pulse is applied to the stimulation device, another perturbation is created in the diameter of the jet at the nozzle that also moves with the jet at $V_{jet}$. It is well known that if the spacing of the perturbations on the jet is greater than Rayleigh limit, that is approximately $\pi$*D, the amplitude of the perturbation can grow (see generally, Lord Rayleigh, "On the Instability of Jets," *Proc. London Math.* Soc. X (1878)). As the perturbation grows, eventually it will grow to the point that it will cause a drop to separate from the jet. On the other hand, if the spacing is less than the Rayleigh limit, the amplitude of the perturbation will shrink, and it will not cause a drop to break off from the jet.

The primary means employed in this invention to improve large-volume droplet coalescence and uniform small-volume droplet stability is by the introduction of a higher frequency burst of stimulations pulses during the time interval that is to form the large-volume droplet. Comparing FIG. 9 to FIG. 5, one sees in FIG. 9, a number of narrow pulses inserted in the gap that was present in FIG. 5 between the first and second pulses. These inserted pulses produce a third set of perturbations on the diameter of the liquid jet. The time period between each "burst mode" pulse and the pulse preceding them is sufficiently short that these burst mode pulses don't induce drop break off, that is that the spacing between perturbations on the jet is less than $\pi$*D. As a result, these inserted perturbations shrink rather than grow in amplitude and therefore will not induce segments of the liquid stream to break off to form individual small droplets. Although these burst mode pulses will not induce individual droplet formation, they are able to alter formation of the large-volume droplet to enhance the coalescence process.

In accordance with one embodiment of the present invention, FIG. 9 is an example of a pulse configuration that can be used to generate eight 1x small-volume droplets and one 4x large-volume droplet for air deflection, and is referred to herein as a "Large-Volume Droplet Burst" waveform. However, one skilled in the art will understand that any number of small volume or large volume droplets may be formed in succession. The waveform parameters are listed in the table of FIG. 10, along with the waveform carrier frequency $F_c$ used for most of these experiments.

The small-volume droplet burst pulses (i.e. the closely spaced pulses in FIG. 9) have the same duty cycle as the other pulses but only one-half the period. Therefore, the burst pulses are generated at twice the frequency as the other pulses. If $\lambda/D$ for the normal pulses is less than $2\pi$, then $\lambda/D$ for the burst pulses is less than $\pi$ and no droplets are generated directly by Rayleigh jet break up from the burst pulses. The burst pulses do, however, have an effect on the droplet generation, as show in FIG. 11. There are several differences to note between the droplets generated by the standard waveform of FIG. 6 and the Burst waveform of FIG. 9. The Burst waveform produces the following changes:

1. The small-volume droplets between the large-volume droplets are spaced much more uniformly.
2. The LDFL is improved, becoming much smaller, as listed in the table of FIG. 12.
3. The SD-SD merging length is improved sufficiently that the merging length is beyond the measurement field.
4. The LD-SD distance is improved and now much longer than the LD-SD merging distance produced by the standard waveform.
5. There is a droplet spacing anomaly between the large-volume droplet and trailing small-volume droplet.

Figures 10, 11:
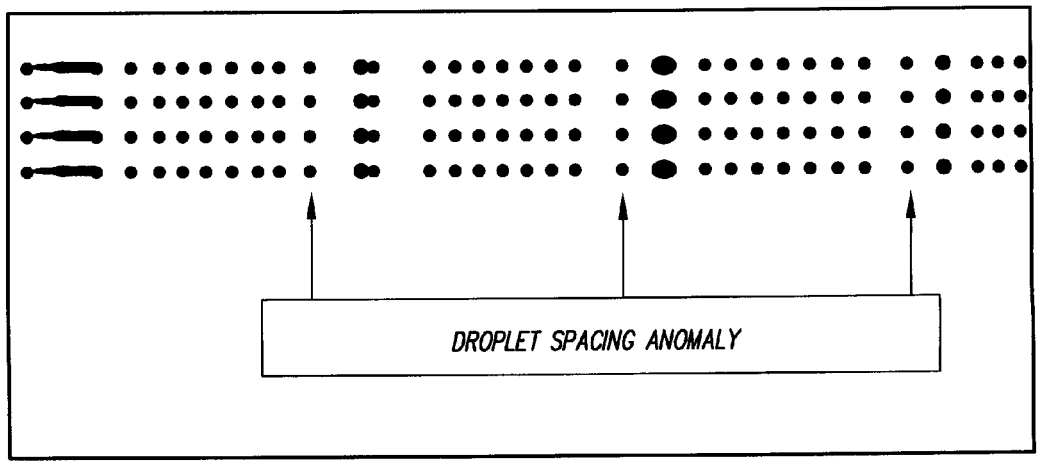
FIG. 10 is a table of data for the waveform of FIG. 9.
FIG. 11 is an image of droplets produced by the waveform of FIG. 9.
Figures 12, 13:
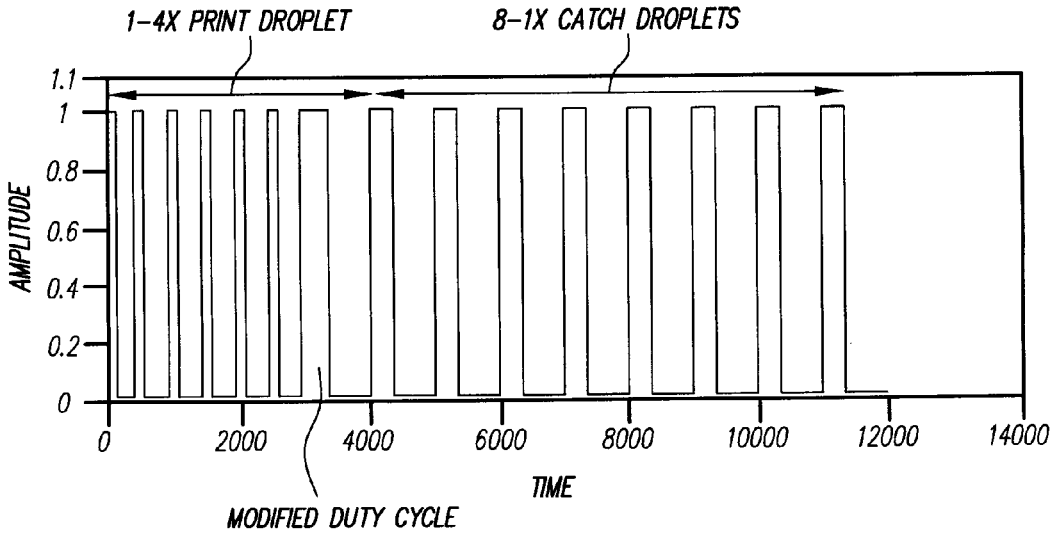
FIG. 12 is a table of the droplet generation results the waveform of FIG. 9.
FIG. 13 is a graph of a waveform for producing a single large-volume droplet followed by eight small-volume droplets according to another feature of the present invention.
Figures 14, 15, 16:
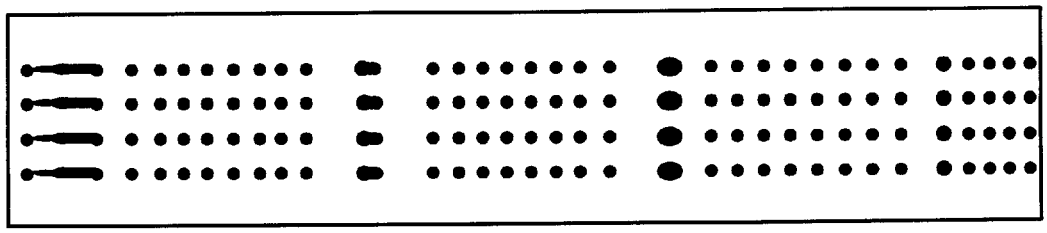
FIG. 14 is a table of data for the waveform of FIG. 13.
FIG. 15 is an image of droplets produced by the waveform of FIG. 13.
FIG. 16 is a table of the droplet generation results the waveform of FIG. 13.

In accordance with another embodiment of the present invention, FIG. 13 is an example of a large-volume droplet burst waveform modified to correct the droplet spacing anomaly of FIGS. 9-11, wherein the last pulse in the inserted burst of pulses has a larger duty cycle than the other pulses in the inserted burst of pulses. The large-volume droplet burst parameters are shown in the table of FIG. 14. The effect of the modification on the small-diameter droplet spacing is shown as FIG. 15.

Figure 17:
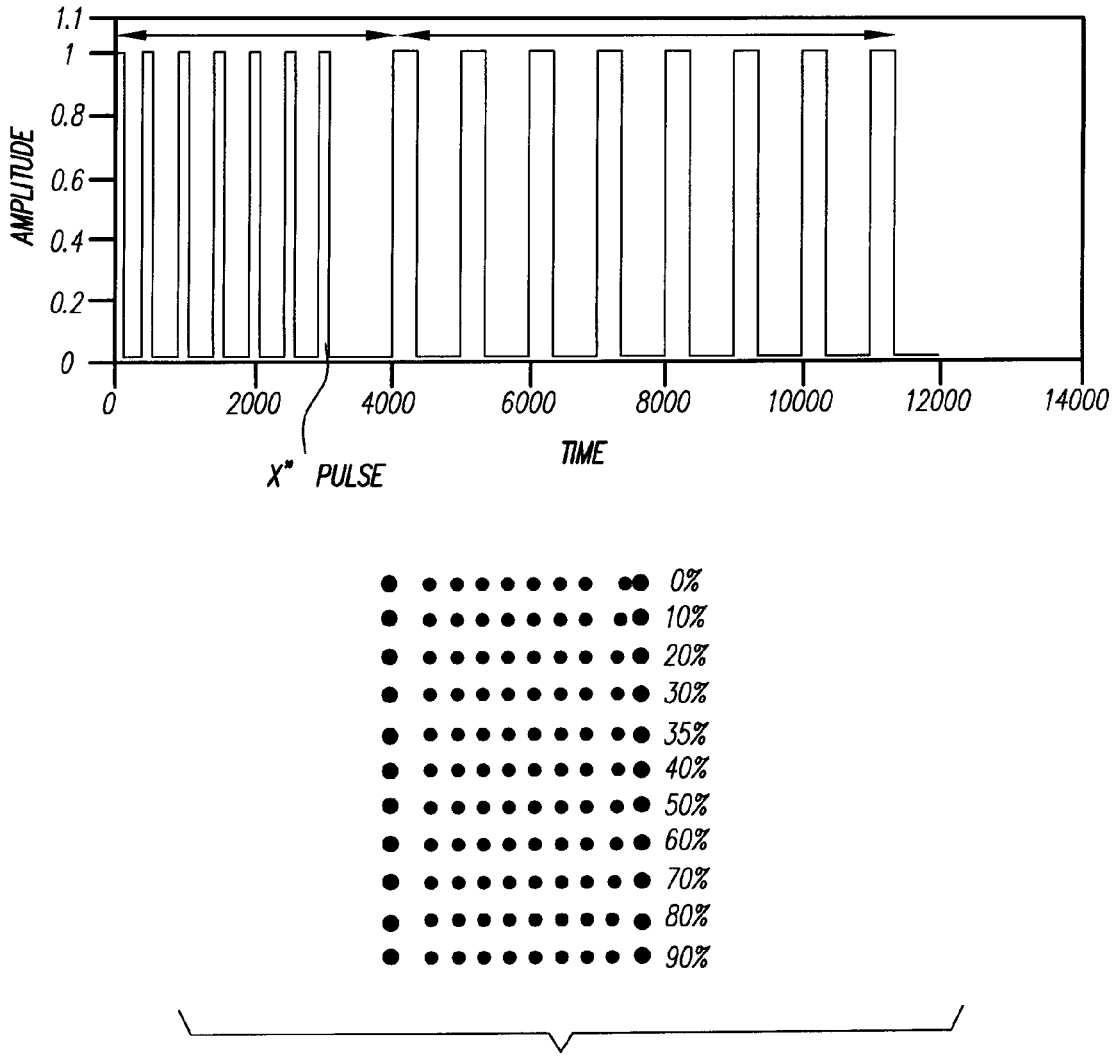
FIG. 17 is an image of droplets produced by the waveform of yet another feature of the present invention.

It can be seen that the small-volume droplet spacing anomaly of the unmodified large-volume droplet burst waveform of FIG. 9 is greatly reduced, or eliminated, by the waveform modification of FIG. 13. This modification is an increase of the last large-volume droplet burst pulse duty cycle from 35% to 80%. This increase serves to make the "off" time between the last large-volume droplet burst pulse and the first small-volume droplet pulse more consistent with the off times between the remaining small-volume droplet pulses. The droplet generation results produced by the modified burst waveform are shown in table of FIG. 16, and show that overall droplet generation performance was improved, in addition to, the elimination of the small-volume droplet spacing anomaly. The duty cycle increase from 35% to 80% of the last burst pulse to modify the large-volume droplet burst waveform was determined by systematically changing the duty cycle of that pulse while observing the effect on droplet spacing and generation performance. The duty cycle of the last burst pulse was varied from 10-90% in 10% steps and the effect on the anomalous small-volume droplet position was recorded as shown in FIG. 17.

In the description above, the frequency of the activation drive pulse during burst of activation drive pulses employed during formation of the large drop have twice the frequency of the activation drive pulses used for creation of the small drop, producing evenly spaced perturbations on the jet having a period half that of the perturbations used to create the small drop. The invention is not limited to this ratio of frequencies.

Figure 18:
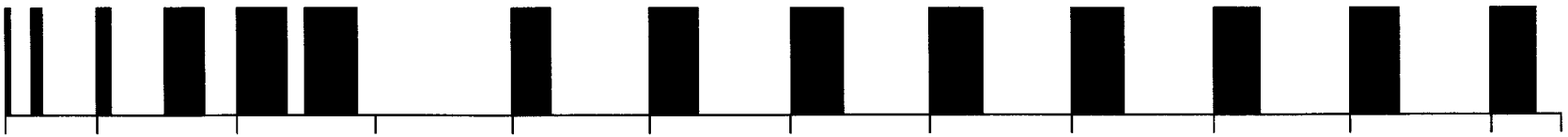
FIG. 18 is a graph of a waveform for producing a single large-volume droplet followed by eight small-volume droplets according to yet another feature of the present invention.
Figure 19:
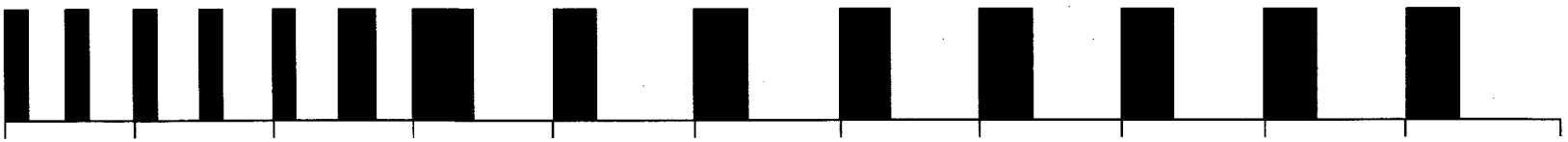
FIG. 19 is a graph of a waveform for producing a single large-volume droplet followed by eight small-volume droplets according to yet another feature of the present invention.

Other methods of custom designing the third set of perturbations may offer features that are different but necessary for a particular CIJ system. For example, and expanding upon the embodiment of FIG. 13, it is not essential that the duty cycle of the pulses that produce the third set of perturbation remain constant. A progressive increase in duty cycle as shown in FIG. 18 provides the benefit of a much shorter coalescence length. Alternatively, a non-systematic approach may be utilized wherein each duty cycle is independently assigned and adjusted to provide the necessary PDFL or LDFL, as shown in FIG. 19.

Other embodiments may include the modulation of the period for the third set, wherein the period increases or decreases with subsequent perturbations. Again, the duty cycle could modulate with each variable period. However, such modulations would require that the number of perturbations within the third set to change accordingly such that the Nx time constraint is not altered.

The invention has been described in detail with particular reference to certain preferred embodiments thereof, but it will be understood that variations and modifications can be effected within the spirit and scope of the invention.

The invention claimed is:

1. A method for operating a liquid drop generator for selective formation of large-volume droplets and small-volume droplets, said method comprising the steps of:

providing a droplet generator having a nozzle opening and an adjustable stimulation device;

supplying a liquid under pressure to the droplet generator such that a liquid stream of a predetermined diameter D emanates from the nozzle opening;

activating the stimulation device to produce a first set of perturbations on the diameter of the liquid stream, said perturbations having a period x such as to cause the liquid stream to form into small-volume droplets;

selectively activating the stimulation device to produce a second set of perturbations on the diameter of the liquid stream, said second set of perturbations having a period Nx such as to cause a segment of the liquid stream to form into a large-volume droplet, whereby the large-volume droplet is N times the volume of the small-volume droplets; and further activating the stimulation device to produce a third set of perturbations on the diameter of the liquid stream during the period Nx, the time period between the perturbations of the third set of perturbations being sufficiently short that the segment of the liquid stream that forms the large-volume droplet is not broken up thereby.

2. A method as set forth in claim 1 wherein the step of activating the stimulation device includes applying an activation drive pulse to the stimulation device.

3. A method as set forth in claim 1 wherein the spacing between the perturbations of the third set of perturbations is less than $\pi$*D.

4. A method as set forth in claim 1 wherein the third set of perturbations is formed by introduction of a burst of activation drive pulses to the stimulation device during formation of the large-volume droplet.

5. A method as set forth in claim 4 wherein the each of activation drive pulses of the burst of activation drive pulses during the formation of the large-volume droplet do not have the same duty cycle.

6. A method as set forth in claim 5 wherein the final activation drive pulse in the burst of activation drive pulses during the formation of the large-volume droplet has a duty cycle greater than the duty cycle of the preceding pulse.

7. A method as set forth in claim 1 wherein N=4.

8. A method as set forth in claim 1 wherein the perturbations of the third set are equally spaced apart.

9. A method as set forth in claim 1 wherein the perturbations of the third set are not equally spaced apart.

10. A method as set forth in claim 1 further comprising separating small-volume droplets from large-volume droplets by deflecting the large-volume droplets and small-volume droplets by applying a force to the small-volume droplets and the large-volume droplets.

11. A method as set forth in claim 10 wherein the force is applied using a continuous gas flow to the droplets.

* * * * *